US010287139B2

(12) United States Patent
Hutton

(10) Patent No.: US 10,287,139 B2
(45) Date of Patent: May 14, 2019

(54) RIG MAST AND RELATED COMPONENTS

(71) Applicant: DRILL RIG SPARES PTY LTD, Wacol, Queensland (AU)

(72) Inventor: Ross Clive Hutton, Bellbowrie (AU)

(73) Assignee: DRILL RIG SPARES PTY LTD, Wacol, Queensland (AU)

( * ) Notice: Subject to any disclaimer, the term of this patent is extended or adjusted under 35 U.S.C. 154(b) by 432 days.

(21) Appl. No.: 15/305,843

(22) PCT Filed: Apr. 24, 2015

(86) PCT No.: PCT/AU2015/000244
§ 371 (c)(1),
(2) Date: Oct. 21, 2016

(87) PCT Pub. No.: WO2015/161341
PCT Pub. Date: Oct. 29, 2015

(65) Prior Publication Data

US 2017/0043984 A1 Feb. 16, 2017

(30) Foreign Application Priority Data

Apr. 24, 2014 (AU) ..... 2014901481

(51) Int. Cl.
*B66C 23/42* (2006.01)
*E21B 7/02* (2006.01)
(Continued)

(52) U.S. Cl.
CPC ..... *B66C 23/42* (2013.01); *B66C 23/701* (2013.01); *E21B 7/023* (2013.01); *E21B 15/00* (2013.01); *E21B 41/00* (2013.01)

(58) Field of Classification Search
CPC ..... B66C 23/42; B66C 23/701; E21B 15/00; E21B 15/04; E21B 7/023; E21B 7/02; E21B 41/00
See application file for complete search history.

(56) References Cited

U.S. PATENT DOCUMENTS 2,808,911 A * 10/1957 McLerran ..... E21B 7/02 254/399
2,817,495 A * 12/1957 Pearl ..... E21B 7/02 173/151

(Continued)

FOREIGN PATENT DOCUMENTS

CA 2474991 C 4/2008

OTHER PUBLICATIONS

International Search Report from the Australian Patent Office for International Application No. PCT/AU2015/000244 dated Jul. 1, 2015.

(Continued)

*Primary Examiner* — Michael E Gallion
(74) *Attorney, Agent, or Firm* — Finnegan, Henderson, Farabow, Garrett & Dunner, LLP

(57) ABSTRACT

There is provided a mast for a rig, comprising a main boom having a lower end adapted for pivotal connection to a mast support of the rig; and a mast stop extending from the main boom. In use, the mast pivots between a stowed condition and an erect condition, and the mast stop abuts the mast support at a position spaced from the lower end, when the mast is in the erect condition.

16 Claims, 5 Drawing Sheets

(51) Int. Cl.

| | |
|---|---|
| ***E21B 15/00*** | (2006.01) |
| ***B66C 23/70*** | (2006.01) |
| ***E21B 41/00*** | (2006.01) |

(56) References Cited

U.S. PATENT DOCUMENTS 3,109,523 A * 11/1963 Moller ..... B66C 23/36 254/335
3,805,463 A * 4/1974 Lang ..... E21B 7/027 173/151
3,905,168 A * 9/1975 Nelmark ..... E21B 7/02 173/28
3,992,831 A * 11/1976 Bukovitz ..... E21B 15/04 52/116
4,016,687 A * 4/1977 Griffith ..... B60P 3/00 173/193
4,138,805 A 2/1979 Patterson
4,138,808 A * 2/1979 Walkiewicz, Jr. ..... E04D 13/1637 52/459
4,290,495 A * 9/1981 Elliston ..... E21B 7/02 166/77.4
4,465,144 A * 8/1984 Gugger ..... E21B 15/04 173/28
4,703,812 A * 11/1987 Johnson ..... E21B 7/02 173/152
5,158,146 A * 10/1992 Fuller ..... E21B 7/024 173/28
5,794,723 A * 8/1998 Caneer, Jr. ..... E21B 15/04 175/202
6,298,927 B1 * 10/2001 Back ..... E21B 19/14 166/77.51
8,782,968 B2 * 7/2014 Benson ..... E21B 15/04 52/116

OTHER PUBLICATIONS

International Preliminary Report on Patentability from the Australian Patent Office for International Application No. PCT/AU2015/000244 dated Aug. 24, 2016.

* cited by examiner

RIG MAST AND RELATED COMPONENTS

CROSS-REFERENCE TO RELATED APPLICATIONS

This application is a national phase application of International Application No. PCT/AU2015/000244, filed Apr. 24, 2015, and claims the priority of Australian Application No. 2014901481, filed Apr. 24, 2014, the content of both of which is incorporated herein by reference.

TECHNICAL FIELD

The present disclosure relates to flushby, workover and intervention rigs. The present disclosure particularly relates to devices and mechanisms affecting the erect condition of the mast of a flushby rig.

BACKGROUND

Flushby rigs are used, inter alia, for clearing blocked oil and gas wells and removing damaged well lining from conventional oil and gas wells, coal seam gas wells and unconventional shale gas wells. During operation of some flushby rigs, the flushby rig is backed up to a well, jack legs are extended to level the deck of the rig, outriggers are extended as a safeguard against rollover of the rig, the teleboom (telescopic boom) of the mast is extended to lift a sheave at the upper end of the teleboom to operating height and the main boom of the mast is rotated into position above the well, and a drawworks winch is operated to lower the drawworks line and travelling blocks down to the well.

The sheave must be positioned directly above the well to provide a vertical drop for the drawworks line from the sheave to the well. It is critical that the drawworks line pass directly (i.e. vertically) upwardly from the well to the sheave. If, for example, the rig is to remove damaged well lining, the lining must be drawn directly upwardly to avoid fracturing and fragmenting of the casing and well head.

In the event that the sheave is not correctly positioned when the rig is set up, the mast is retracted and stowed, the outriggers and jack legs are drawn in and the position of the rig is reset. Thus considerable time is lost in repositioning the rig.

A mast can be connected to a support on the rig, by a pivot or hinge. The support is fixed to the deck of the rig and the mast pivots on the support between a stowed condition and an erect condition. To fix the mast in the erect condition, the outer boom is bolted to the support and guy ropes are provided to stabilize the mast. With the exception of lift raise cylinders used to lift the mast, the mast is held in position by the bolts and guy ropes. Due to the tremendous forces that can be applied through the mast by out of balance rope loads, particularly where impulse loads are experienced, such as in the event of a sudden blockage or where rocks are encountered, the mast is subject to oscillations back and forth. These problems can lead to premature fatigue and failure of the pivot, mast and support that connects the mast to the body of the rig.

SUMMARY

The present disclosure may be applied to various types of rig including flushby, workover and intervention rigs.

The present disclosure provides a mast for a rig, comprising:

a mast stop extending from the lower end of the main boom, wherein, in use, the mast pivots between a stowed condition and an erect condition, and the mast stop abuts the mast support at a position spaced from the lower end, when the mast is in the erect condition.

The mast stop may abut the mast support when the mast moves into the erect condition.

A portion of the mast support may be brought into contact with the mast when the mast is in the erect condition, to resist movement of the mast.

In some examples of use of the mast, a supporting plate may be connected to the mast support of the rig. A variable wedge apparatus—for example a pivot wedge—may also be provided on the mast support, the variable wedge apparatus allowing the mast to be locked in position at any one of a range of operating angles. The range of angles may be continuously variable. The range of angles may comprise a predetermined number of specific or discrete angles. In these examples, the mast may pivot over the range of operating angles in the erect condition, and be locked in any one of the operating angles. Specifically, the mast may be locked at an angle that locates a sheave (at an upper end of the mast) above the well using. The variable wedge apparatus is then inserted between the support plate attached to the rig and the mast stop.

The main boom has an upper end opposite the lower end, and the mast stop may extend from the lower end and longitudinally of the mast—in other words, the mast stop may extend in a direction away from the upper end, and parallel to a longitudinal direction of the mast. The mast stop may extend in a direction other than in a longitudinal direction of the mast.

The main boom may have a substantially constant cross-section along its length. The main boom may be of box section in nature. The main boom may be of fabricated structure in nature. The cross-section of the main boom may instead vary along its length. For example, the cross-section of the main boom may vary to achieve a desired load distribution across the main boom at the pivot. The cross-section of the main boom may be substantially square. The cross-section of the main boom may alternatively be any other desired shape.

The mast may include one or more reinforcing members. Each reinforcing member may comprise a blade or fin. The blade or fin may be on a side of the main boom. Two such blades or fins are may provided. The two blades or fins may be positioned on opposite sides of the main boom. The blades or fins may project from the sides in a form parallel to the longitudinal direction of the main boom. The blades or fins may taper upwardly, towards the mast. The main boom and secondary boom may each comprise one or more such reinforcing members. Each reinforcing member increases the stability and buckling resistance of the mast.

The mast stop may abut the mast support at a position spaced from the pivotal connection of the mast. The mast stop may apply a force to the mast support, in use, that acts perpendicularly to the pivot axis of the lower end of the main boom. The mast stop may alternatively apply a force at a desired angle to the pivot axis. The mast stop may be designed to resist a predetermined maximum force. The predetermined maximum force may be a force sufficient only to prevent over-rotation of the mast past its operating (i.e. erect) position. The predetermined maximum force may instead only be a force sufficient to counter momentary fluctuations in loads on the mast—for example, where the drawworks encounter rock or blockages that apply an impulse load to the mast.

The erect condition of the mast may be preset—in other words, set before the mast reaches the erect condition—to be a position in which all of the force likely to be encountered, during normal use of the drawworks, will act through the pivotal connection with the mast support. The erect condition of the mast may be preset to be a position in which none of the force likely to be encountered, during normal use of the drawworks, will be applied between the mast stop and mast support. The position of the mast in the erect condition may be preset by moving a portion of the mast support into a position, before the mast is in the erect condition, in which position abutment of the mast thereagainst will prevent further movement of the crown of the mast away from a cabin of the rig.

The mast stop may be positioned on the main boom, to one side of the main boom. The mast stop may extend from the lower end of the main boom at the rearward side of the boom when the boom is in the erect condition.

The mast stop may have a duckbill shape. The mast stop may comprise a main bearing plate attached (e.g. by welding, by bolts or any other appropriate means) to the main boom and extending substantially side-to-side relative to the deck of the rig. In use, the bearing plate may abut the mast support when the mast is in the erect condition. In use, the bearing plate may abut the mast support when the mast is in the erect condition.

The bearing plate may comprise one or more fastening points by which the bearing plate is fastened to the mast support, in use. Each fastening point may comprise a slot for receiving a bolt. The bearing plate may comprise two fastening points.

The bearing plate may be supported by one or more rigidifying members that resist flexion in the bearing plate out of the plane of the bearing plate. The one or more rigidifying members may include on or more reinforcing ribs. Each reinforcing rib may project perpendicularly from the bearing plate. Each reinforcing rib may extend substantially the length of the plate. Each reinforcing rib may extend in a longitudinal direction of the main boom. There may be a plurality of rigidifying members. Each of the plurality of rigidifying members may comprise a reinforcing rib.

The mast may be moveable between the stowed and erect conditions by one or more mast lift cylinders. There may be two such mast lift cylinders. Each mast lift cylinder may be associated with extension indicator for determining an extension of the respective cylinder. Each extension indicator may comprise a linear sensor. There may be a separate extension indicator associated with each mast lift cylinder.

The pivotal connection between the main boom and mast support may comprise a hinge member. The hinge member may comprise one or more hinges. The hinges member may comprise a plurality of hinges. The plurality of hinges may comprise three hinges. Two hinges of the plurality of hinges may be located on opposite sides of a longitudinal centerline of the main boom. The two hinges may, or alternatively may not, be spaced from the centerline of the main boom. The hinge, or one of the hinges, may be located on the centerline of the main boom—part of this hinge may comprise part of the lower end of the main boom.

The mast support may comprise a frame for supporting the mast above a deck of the rig, in use. The frame may comprise one or more riser members. The frame may comprise two riser members. A jack for leveling a deck of the rig may retract into the or each riser member. Each jack may be provided with a sensor for determining when the jack is extended to ground. Each sensor may comprise a proximity sensor.

The frame may include one or more lateral members extending between the riser members. The frame may include a first lateral member for mounting the mast. The mast may be pivotally connected to the first lateral member. The frame may include a second lateral member for mounting an abutment mechanism. The mast stop may abut the abutment mechanism when the mast is in the erect condition. The mast stop may abut the abutment mechanism when the mast is in the erect condition.

The mast stop may be fixed in position in relation to the mast. Consequently, the angular position of the mast stop may depend on the angle of the mast when in the erect condition. The mast support may be configurable so that the mast stop makes full contact (i.e. surface to surface) with the mast support regardless of the angular position of the mast when in the erect condition. The mast stop may abut an abutment mechanism of the mast support. The position of the abutment mechanism may be variable to accommodate variations in angular position of the mast stop when the mast is in the erect condition. The position of the abutment mechanism may be changed before movement of the mast into the erect condition, for example to set the maximum angle of the mast when in the erect condition, or after movement of the mast into the erect condition.

It will be noted that the terms "angular position", "angular orientation", "orientation" and similar will be used interchangeably herein, and are intended to refer to the angle of the relevant part—for example, the mast or mast stop—when the mast is in the erect condition.

A secondary boom may extend from the main boom. The secondary boom may extend from the upper end of the main boom. The secondary boom may have the same cross-sectional shape as the main boom. The secondary boom may be a teleboom.

The secondary boom may be extended and retracted by an extender. The extender may comprise an extension cylinder. The extension cylinder the may be disposed internally of the main boom.

The extension of the secondary boom may be limited, in use, by one or more limit members. The one or more limit members may comprise a locking pin. The one or more limit members may comprise a locking pin. The one or more limit members may comprise a pair of, or multiple, locking pins. A position detecting means may be located at each limit member to detect when the secondary boom is at or near the limit member. Each position detecting means may comprise a proximity sensor.

The secondary boom may have a lower end within, or in connection with, the main boom. The secondary boom may have an upper end distal from the main boom. A drawworks line guide may be attached to the upper end of the secondary boom. The drawworks line guide may comprise a sheave.

The present disclosure further provides a mast assembly for a rig, comprising:

- a mast having a lower end adapted for connection to a mast support, and an upper end opposite the lower end, the mast being moveable between a stowed condition and an erect condition; and
- a guide member at the upper end of the mast for running a drawworks line of the rig, wherein a centerline of the guide member is offset from a centerline of the mast in a rearward direction when the mast is in an erect condition.

The guide member may comprise a sheave.

The guide member may comprise an oversized sheave, so that a rearmost part of the circumference of the sheave is positioned further rearwardly, when the mast is in an erect condition, than would the rearmost part of the circumference of a standard sized sheave when in the same position on the mast.

The mast may be moveable between the stowed and erect conditions by one or more mast lift cylinders as described above. The one or more mast lift cylinders may be the only mechanism by which the position of the mast is maintained when in the erect condition. Alternatively, one of a variety of support mechanisms may be provided to assist in maintaining the position of the mast when in the erect condition. The mast may, for example, include a mast stop as described above to assist in maintaining the position of the mast when in the erect condition by abutting a mast support.

It will be noted that phrases describing "the mast moving to the erect condition" are intended to include within their scope any position of the mast after it has left the stowed condition to move to the erect condition. Other phrases such as "when the mast reaches the erect condition" or "when the mast is in the erect condition" are intended to convey that point at which the mast enters the erect condition, and phrases such as "as the mast moves into the erect condition" are intended to convey that the mast is immediately to enter the erect condition.

The present disclosure also provides a mast support for a mast of a rig, comprising:

a bearing surface;

an abutment mechanism positioned between the mast and bearing surface, in use, and when the mast is in an erect condition to limit an angular position of the mast relative to the bearing surface; and an adjustment device for adjusting a position of the abutment mechanism on the bearing surface to match the angular position of the mast when in the erect condition.

When in use, the bearing surface may be fixed in position on the rig. The abutment mechanism and bearing surface may thus limit the angular position of the mast relative to the body or deck of the rig when the mast is in the erect condition.

The bearing surface may comprise a flat plate. The bearing surface may be formed from steel. The bearing surface may be welded or bolted to the mast support. The bearing surface may extend at an angle to vertical (i.e. normal to the deck of the rig when in use), upwardly towards the cabin.

The abutment mechanism may slide up and down the bearing surface. Sliding of the abutment mechanism may be under action of the adjustment device. In moving up and down the bearing surface, the abutment mechanism may move toward or away from a cabin of the rig, respectively.

The abutment mechanism may be sandwiched between the mast and bearing surface, in use, when the mast is in the erect condition. The abutment mechanism may wedge between the mast and bearing surface, in use, when the mast is in the erect condition. The abutment mechanism may be adjustable so that the mast abuts a flat surface of the abutment mechanism when the mast is in the erect condition, regardless of the angle of the mast when in that condition. The abutment mechanism may be moved into position on the bearing plate either before, or after, movement of the mast into the erect condition.

The abutment mechanism may be in the form of a butterfly pivot. The abutment mechanism may comprise a pivot wedge. The pivot—referring to either the butterfly pivot or pivot wedge—may wedge between the mast and bearing surface, in use.

The pivot may comprise two parts that are pivotally joined together. Each of the two parts may comprise a triangular prism. The triangular prismatic parts may be pivotally joined along an apical edge.

The base of a first of the two parts may bear against the bearing plate. The first part may slide along the bearing plate to adjust a position of the abutment mechanism on the bearing plate. The base of the second part, of the two parts of the pivot, may abut the mast stop when the mast is in the erect condition. The angular orientation of the first part relative to the second part, and thus the angular orientation of the base of the first part relative to the base of the second part, may therefore be variable. The second part may pivot, relative to the first part, under action by the mast stop against the second part, as the adjustment mechanism urges the abutment mechanism between the bearing surface and mast.

Pivoting of the second part relative to the first part may ensure the base of the second part is always flat against the mast stop once the mast reaches the erect condition. In other words, the variability in the angular orientation between the bases of the first and second parts may facilitate engagement of the abutment mechanism by the mast, regardless of the angular orientation of the mast when in the erect condition.

The abutment mechanism may limit the mast angle to a predetermined maximum angle. The predetermined maximum angle may be 7° past vertical. The abutment mechanism may prevent movement of a crown of the mast away from a cabin of the rig, in use. A lower end of the mast may be releasably fixed in position in on the rig (e.g. on the bearing surface), in use, thereby to prevent movement of a crown of the mast towards a cabin of the rig.

The mast support further includes an adjustment device for adjusting a position of the abutment mechanism on the bearing surface. Operation of the adjustment device may adjust the angular position of the mast when in the erect condition, if the abutment mechanism is moved into position in advance of the mast reaching the erect condition. Adjusting the position of the abutment mechanism on the bearing surface may afford a change in the angular orientation of the mast when in the erect condition.

The adjustment mechanism may be extendable and retractable to adjust a position of the abutment mechanism on the bearing surface. The position of the abutment mechanism on the bearing surface may be determined by the position of the mast when in the erect condition.

The adjustment device may comprise a pneumatic cylinder or an hydraulic cylinder. The limits of the adjustment mechanism may be selected so that the abutment mechanism is positioned to match the maximum rotation of the mast past vertical, when the adjustment mechanism is in one of a fully extended condition or a fully retracted condition. Preferably, the abutment mechanism is positioned to match maximum rotation of the mast past vertical, when the adjustment mechanism is in the fully retracted condition. Preferably, the abutment mechanism is positioned to match minimum rotation of the mast past vertical, when the adjustment mechanism is in the fully extended condition.

The maximum rotation of the mast past vertical may be 7°. The minimum rotation of the mast part vertical may be 2.8°.

When compared with prior art rigs, rigs constructed using the mast, mast assembly or mast support described above may provide greater flexibility in angular orientation of the mast for a particular position of the rig relative to a well, and/or greater stability in the rig. Rigs constructed using the mast support described above may provide a mechanical brake, namely the abutment mechanism, for limiting rotation of the mast past vertical and/or precluding movement of the mast past the desired angle when in the erect condition. Rigs constructed using the mast assembly described above may enable the vertical drop of the drawworks to be positioned further rearwardly of the rear of the deck of the rig than is achieved by prior art rigs, without having to increase the angle of the mast.

Some embodiments of the mast, and rig, described herein may be less reliant on bolt and guy rope methods to maintain the position of the mast. Some embodiments of the mast, and rig, described herein may provide a mechanism or device by which the vertical drop of the drawworks line can be positioned over a wider range of horizontal distances than is achieved by existing rigs, without having to relocate the rig.

BRIEF DESCRIPTION OF THE DRAWINGS

The present disclosure will now be described by way of non-limiting example only, with reference to the accompanying drawings, in which.

DETAILED DESCRIPTION

Figure 1:
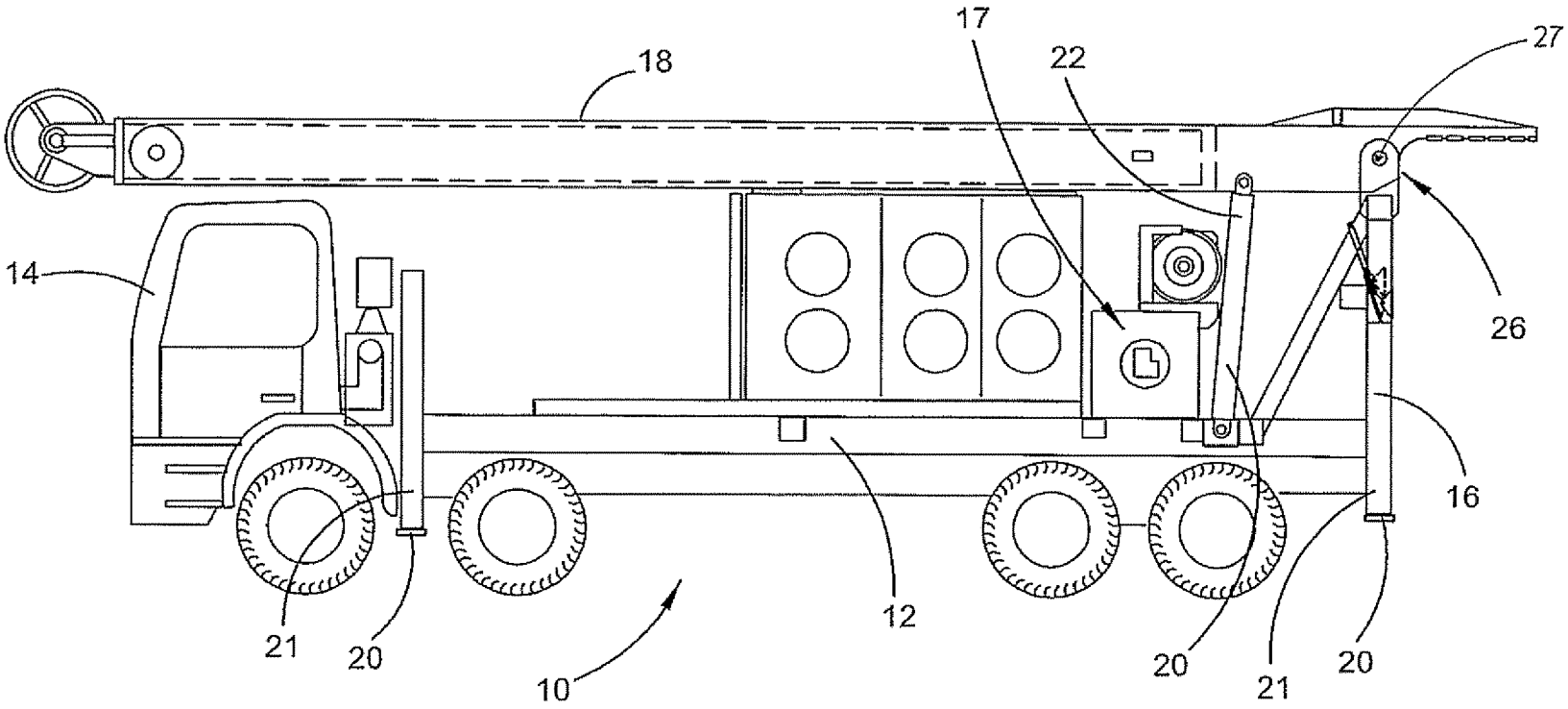
FIG. 1 is a side view of a flushby rig with the mast in a stowed condition.
Figure 2:
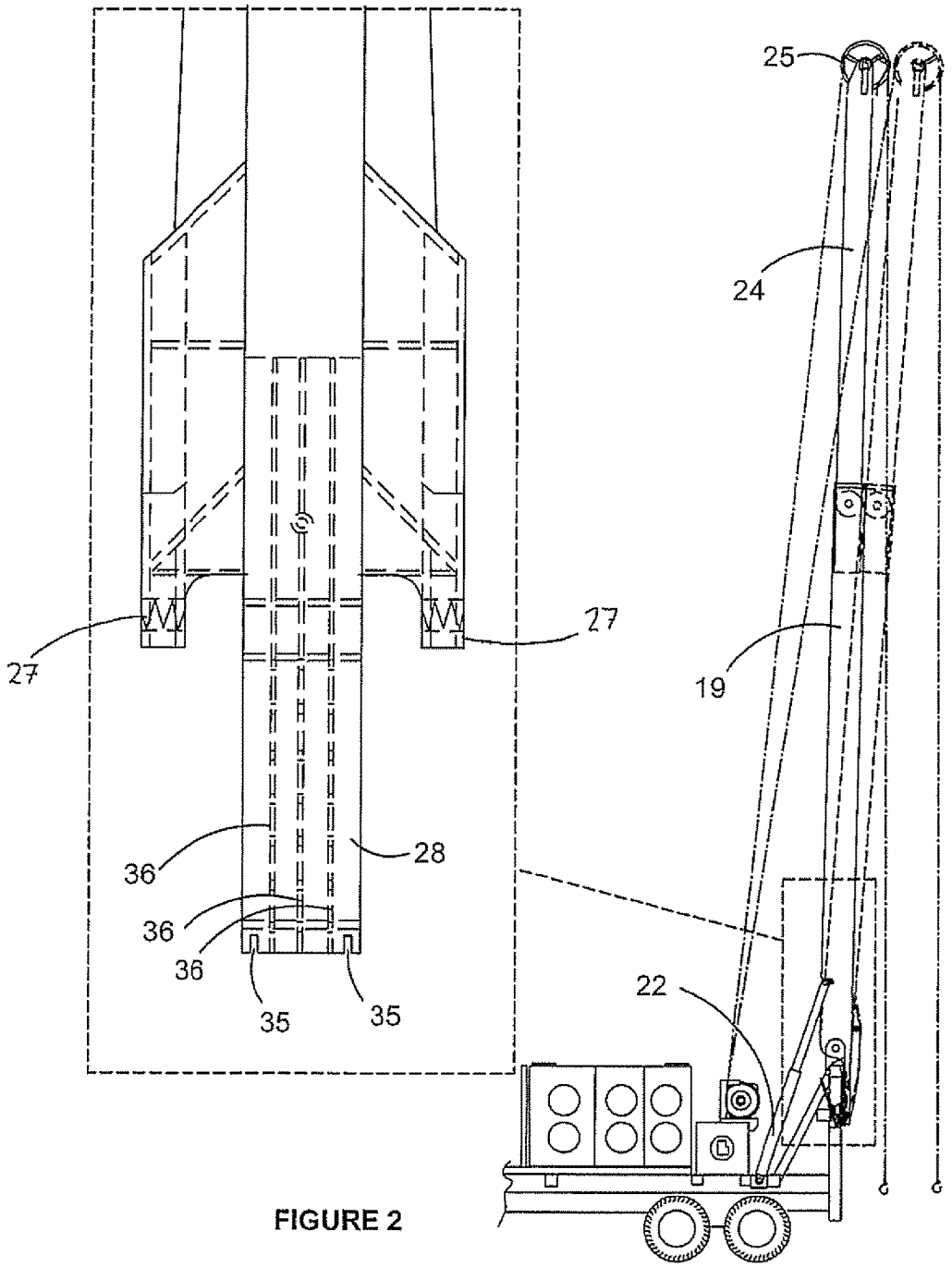
FIG. 2 provides a partial side view, and an enlarged partial side of, of the flushby rig of FIG. 1, with the mast in an erect and extended condition at 7° past vertical (broken lines) and at 2.4° past vertical (solid lines)

FIG. 1 shows a flushby rig 10 for performing well cleaning and well clearing services. The rig 10 is shown in a travelling configuration. The rig 10 includes a truck body, comprising a deck 12, with a cabin 14 at one end and a mast support at the opposite end. The mast support is in the form of a frame 16 and supports a mast 18 that is moveable between a stowed condition, as shown in FIG. 1, and rotating about the mast pivot 27 to an erect condition as shown in FIG. 2.

To position the rig 10, the rig 10 is reversed until it is located at suitable distance from the well (not shown) to perform the well servicing. During reversing, the longitudinal centerline of the rig 10 is aligned with the well (not shown).

The rig 10 is stabilized using jack legs and outriggers. In the rig 10 shown in FIG. 1, two pairs of stabilizer jack legs 20 are provided, one pair at either end of the deck 12. The jack legs 20 are extendable from a stowed condition as shown in FIG. 1, to an extended condition in which the foot of each jack leg 20 bears against the ground. The jack legs 20 level the deck 12 after the rig 10 has been moved into position at a well.

Proximity switches may be used to indicate that the outriggers are in place and the jack feet are in contact with the ground.

Level sensors (not shown) are provided on the deck 12 to identify that the deck 12 is level in a horizontal plane. The jack legs 20 are adjusted until the deck 12 is level. A 'level' condition of the deck 12 is typically considered to be within 0.1° of horizontal.

At the rear of the deck 12 is a pair of outriggers (not shown) that are extended after the deck 12 has been leveled. The outriggers stabilize the deck 12 including providing resistance to movement from wind loading. A proximity switch may be provided on each outrigger to ensure that the outrigger jack leg of each outrigger, is in contact with the ground.

The level sensors (not shown) that determine whether the deck 12 is level may be inclinometers. If the rig 10 moves by more than 0° from its horizontal position, the driller will be warned and the winching or pumping operation will cease.

To raise the mast 18 the mast raise cylinders 22 are activated attached to the main boom 19 with the teleboom 24 retracted. Absolute verticality is typically not essential at this stage.

The mast 18 comprises a main boom 19 and a secondary boom—the secondary boom is in the form of a teleboom 24. In this configuration, the main boom 19 forms the outer boom and the teleboom 24 forms the inner boom. Once the mast 18 is substantially vertical, the teleboom 24 is extended from the main boom 19 using an extender, in the form of a teleboom extension cylinder (not shown), until the teleboom extension cylinder is at its limit—in other words, the teleboom extension cylinder is fully extended. Two locking pins (not shown), are then inserted to lock the teleboom 24 in an extended condition. A sensor, such as a proximity sensor, on each locking pin indicates that the respective locking pin has engaged the teleboom 24. Similarly, the teleboom extension cylinder includes a proximity sensor to determine when the cylinder is at full extension. The proximity sensor of the teleboom extension cylinder and the proximity sensors of the locking pins can be used to lock out, and prevent operation of the drawworks and other equipment, until the locking pins and cylinder 25 are locked in their respective positions.

Once the teleboom 24 is at the desired extension the mast raise cylinders 22 then rotate the mast 18 into the operating. The extension of the mast raise cylinders 22 is controlled until the mast 18 is at the desired angle—the desired angle with typically be when the 'hook' or vertical drop of the drawworks from the sheave 46 (discussed below) is directly above the well head.

The mast 18 is secured in position by bolting the mast 18 to a bearing plate 38 that forms part of the mast support, using tension bolts and nuts 45. This securing step thus involves the use of the duckbill 28, the bearing plate 38, the abutment mechanism (pivot wedge 32—discussed in detail below) and the tension bolts & nuts 45. The bearing plate 38 is located in position on the mast support frame 16 on the rig 10. An abutment mechanism (pivot wedge 32) is then driven between the bearing plate 38 and duckbill 28. The bolts and nuts 45 fixing the duckbill 28 to the bearing plate 38 prevent outward movement of the duckbill 28 and hence movement of the crown 25 of the mast 18 towards the cabin 14. The abutment mechanism, specifically pivot wedge 32 acting on bearing plate 38, prevents movement of the crown of the mast 18 away from the cabin 14.

The rig 10 is designed to be set up with the teleboom 24 in either the extended or retracted condition. Once the rig 10 itself has been appropriately positioned, there is a common zone where the mast can be operated either in the teleboom retracted or extended position. Higher loads can be applied to the drawworks winch in the teleboom retracted position and the rig 10 can be operated in either the teleboom retracted or extended position without moving the rig 10.

The lower end 26 of the main boom 19 is adapted for pivotal connection to the frame 16 of the rig 10. The main boom 19 pivots on the mast support 16 between the stowed condition shown in FIG. 1 and the erect condition shown in FIG. 2. A mast stop, presently in the form of a duckbill 28, extends from the lower end 26 of the main boom 19, and abuts the frame 16, specifically the bearing plate 38, at a position spaced from the lower end 26, when the mast 18 reaches the erect condition. As discussed below, when the pivot wedge 32 is retracted, the mast 18 is at a limiting angle when it contacts the pivot wedge 32. That limiting angle may be 7°, or another limiting angle that is suitable for the rig 10. The limiting angle is the maximum angle of the mast 18 during operation of the rig 10.

Figure 5:
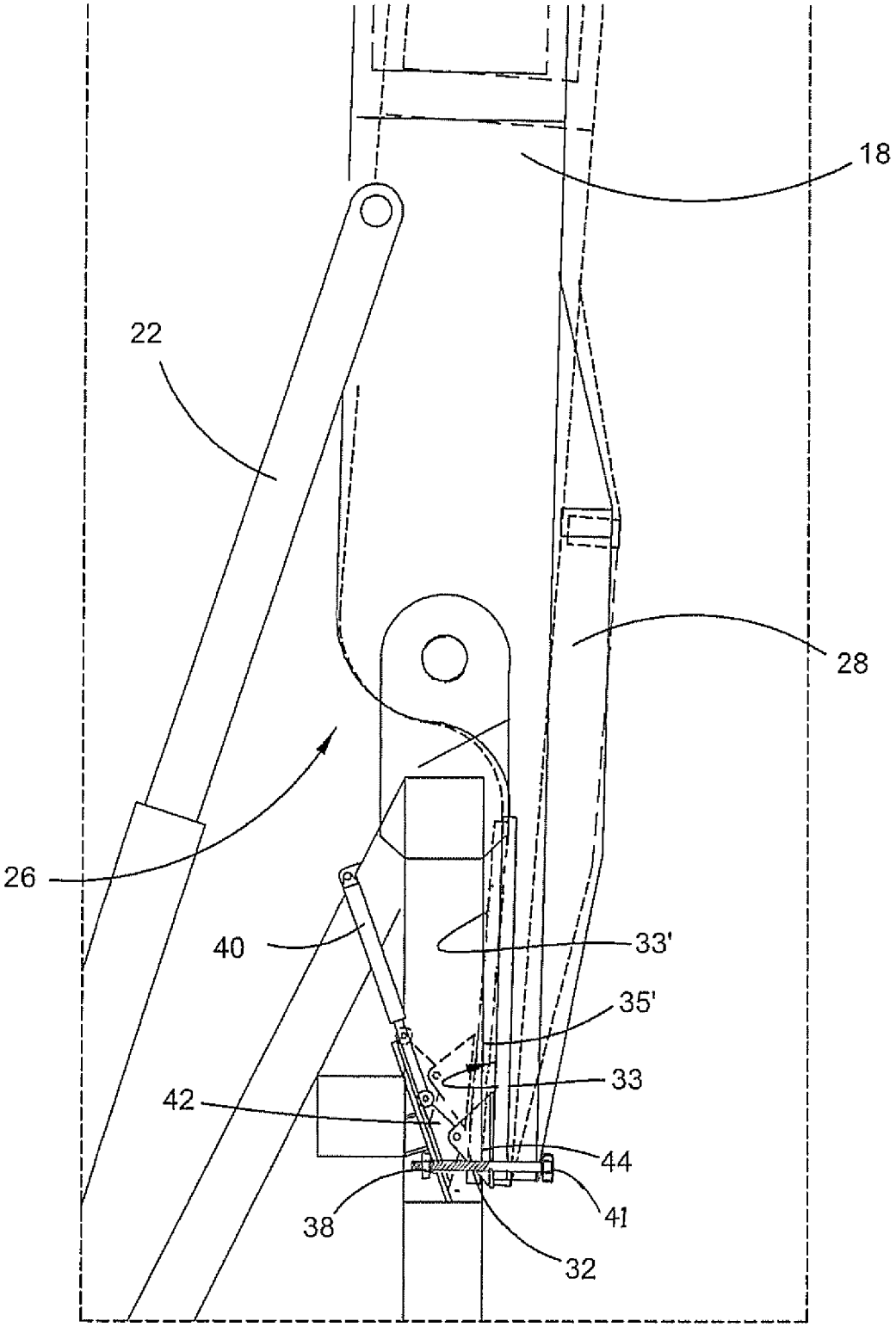
FIG. 5 is a close-up side view of a duckbill and pivot wedge arrangement.

The duckbill 28 abuts an abutment mechanism in the form of a variable wedge apparatus or pivot wedge 32, when the mast 18 is in the erect condition. As discussed below, the configuration of the pivot wedge 32 is variable. The variable configuration enables the pivot wedge 32 to always be in firm contact with the bearing plate 34 of the duckbill 28 and the bearing plate 38 of the frame 16 when the mast 18 reaches the erect condition, irrespective of the angle of the mast 18 when in that condition. For example, as shown in FIG. 5, the duckbill 28 and pivot wedge 32 are shown in a first condition (in solid lines) in which the mast 18 and duckbill 28 are at a first angle Also in FIG. 5, the duckbill 28 and pivot wedge 32 are shown in a second condition (in broken lines) in which the mast 18 and duckbill 28 are at a second angle, different from the first angle, and the pivot wedge 32 has automatically adjusted to make full contact (i.e. surface to surface) with the bearing plate 34 of the duckbill 28 while remaining in contact with the bearing surface 38. In this manner, the duckbill 32 and mast support (e.g. bearing plate 38 and wedge 32) form a mechanical brake for preventing over-rotation of the mast 18 past the desired angular position when in the erect condition. Moreover, the mechanical brake force applied by the duckbill 32 is transverse to, and spaced from, the pivot axis of the mast 18.

The duckbill 28 applies a force perpendicular to the pivot axis of the lower end 26 of the main boom 19. If the angular position of the mast 18 is properly set, the force acting through the main boom 19, during operation on the well, will act directly through the pivot axis. Therefore the duckbill 28 need only be designed to apply a force sufficient to prevent over-rotation of the mast 18 towards its operating (i.e. erect) position and/or a force sufficient to counter momentary fluctuations in position of the mast 18 due to impulse loads on the mast 18. In ideal operation, the main boom 19 will be positioned so that all force acts through the mast 18 and pivot axis, with no force being applied through the duckbill 28.

While the duckbill 28 is to one side of the main boom 19, the duckbill 28 extends in a direction parallel to a longitudinal direction of the mast 18. The duckbill 28 extends from the lower end 26 and away from the upper end 30. As such, the contact between the duckbill 28 and the pivot wedge 32 is spaced from the pivot axis of the mast 18. When compared with a brake that brakes movement of a mast by acting on the pivot of the mast, the duckbill 28 can apply substantially less force in order to impart the same braking force. This is due to the contact between the duckbill 28 and pivot wedge 32 being spaced from the pivot axis of the mast 18, thereby comparatively lengthening the moment arm over which the braking force is applied. Also rather than applying a braking force to the pivot of the mast, the mast stop, or duckbill, applies a braking force to the mast itself. In other words, the force is applied to the mast, rather than to the pivot.

The duckbill 28 comprises a main bearing surface in the form of a plate, or series of plates, 34 welded to the main boom 18 and extending substantially side-to-side relative to the deck 12 of the rig 10. In use, the bearing plate 34 abuts the mast support when the mast 18 is in the erect condition. As best seen in FIG. 2, the bearing plate 34 is supported by a plurality of reinforcing ribs 36 projecting perpendicularly from the bearing plate 34. The reinforcing ribs 36 extend substantially the length of the plate 34 in a longitudinal direction of the main boom 19. The ribs 36 resist flexion in the bearing plate 34 out of the plane of the bearing plate 34, thereby rigidifying the bearing plate 34.

As mentioned above, the duckbill 28 abuts the pivot wedge 32 when the mast 18 is in the erect condition. To maintain the pivot wedge 32 in position, the frame 16 of the mast support includes a bearing surface in the form of a plate 38, and the pivot wedge 32 wedges between the mast 18 and bearing plate 38 when the mast 18 is in an erect condition. The pivot wedge 32 and bearing plate 38 thereby work together to limit the angular position of the mast 18 relative to the body or deck 12 of the rig 10.

To ensure the mast 18 remains in the erect condition, the duckbill 28 is fixed to the bearing plate 38. To this end, the bearing plate 34 includes two fastening points in the form of slots—see FIG. 2. The two slots 35 are positioned toward opposite sides of the lower end of the bearing plate 34. When the mast 18 is in the erect condition and the bearing plate 34 abuts the pivot wedge 32, bolts or another type of fastener 41 are inserted through the bearing plate 34 and the bolts are secured against bearing plate 34.

The mast support further includes an adjustment device in the form of a cylinder 40, to move the pivot wedge 32 in order to accommodate changes in desired angular position of the mast 18. The cylinder 40 adjusts the position of the pivot wedge 32 between bearing plate 38 and bearing plate 34. In use, the mast 18 is set to the desired angle and the cylinder 40 is actuated to insert the pivot wedge 32 between the bearing plates 34, 38 to abut the bearing plates 34, 38. Further and thus the angle of the mast 18 when in the erect condition increases. Conversely, where the contact point is lowered, the angle of the mast 18 when in the erect condition is reduced. Operation of the cylinder 40 thereby adjusts the position of the pivot wedge 32 to match the angular position of the mast 18 when in the erect condition. The cylinder 40 may be replaced by any other adjustment member, such as a winch, or ratchet member, or any other suitable means for adjusting the position of the abutment mechanism.

Once the pivot wedge 32 has been urged between bearing plates 34, 38 the bolts and nuts 41 can be tensioned (i.e. tightened) to secure the bearing plates 34, 38 in position. Alternatively, the bolts and nuts 41 may be tightened before the pivot wedge 32 is inserted. In either case, the pivot wedge 32 and bearing plate 38 prevent movement of the crown of the mast 18 away from the cabin 14 and towards and well (not shown). Similarly, the bolts and nuts 41 prevent movement of the crown of the mast 18 towards the cabin 14 and away from the well.

Figure 3:
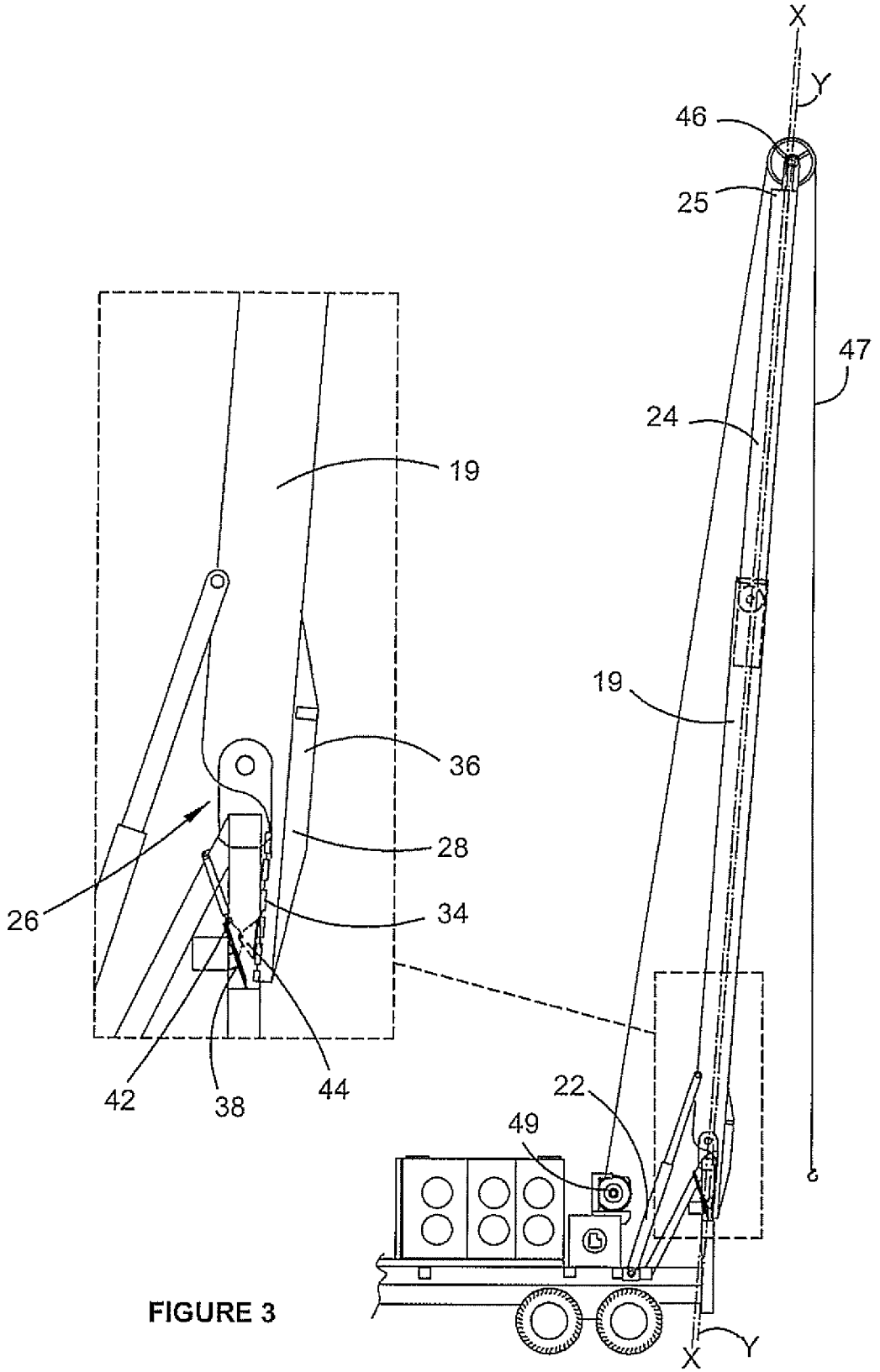
FIG. 3 is a simplified version of FIG. 2.
Figure 4:
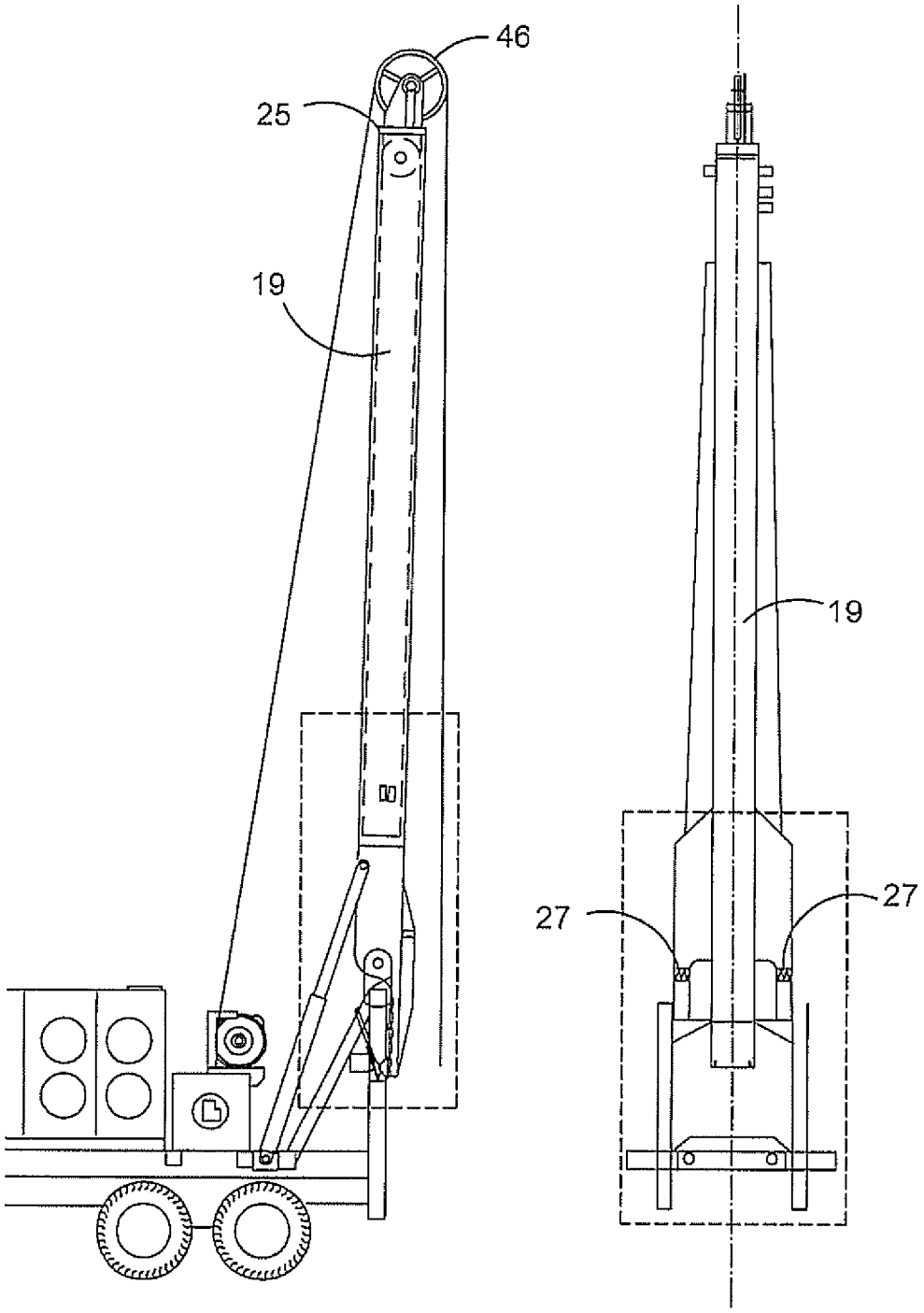
FIG. 4 provides a partial side view, and a partial rear end view, of the flushby rig of FIG. 1, with the mast in the retracted condition.

The bearing plate 38 is a flat, steel plate welded to a frame 16 of the mast support. The bearing plate 38 extends at an angle to the vertical, upwardly towards the cabin 14 as shown in FIG. 3. Therefore, as the pivot wedge 32 slides up and down the bearing surface under action of the cylinder 40, it moves either slightly toward or away from the cabin 14 respectively.

The bearing plate 38 may provide one or more indicia that identify one or more positions of the pivot wedge 32, the positions corresponding to predetermined angular positions of the mast 18 when in the erect condition. An operator therefore need only adjust the cylinder 40 to move the pivot wedge 32 to the desired one of the indicia, and the angular position of the mast 18 when in the erect condition will appropriately limited. The indicia may be used for the operator to identify the maximum load on the drawworks—there may be two such indicia to identify the maximum load on the drawworks for the mast 18 at the relevant angle, in both the extended and retracted conditions (i.e. with the secondary mast, or teleboom 24, extended or retracted).

The pivot wedge 32 is in the form of a butterfly pivot. Two triangular prismatic halves 42, 44 of the pivot wedge 32 are pivotally joined along an apical edge. The base of a first half 42 of the pivot wedge 32 bears against the bearing plate 38, and slides along the bearing plate 38 to adjust a position of the pivot wedge 32 on the bearing plate 38. The base of the second half 44 abuts the duckbill 28 when the mast 18 is in the erect condition. Thus the angular orientation of the first half 42 relative to the second half 44 is variable.

Since the angle of the mast 18 when in the erect condition changes depending on the angle necessary to position the upper end of the teleboom 24 (i.e. sheave 46 as discussed below) above the well, as discussed below, the angle of the plate of the duckbill 28 similarly changes as discussed above. Since the pivot wedge 32 is in the form a butterfly pivot, the second half 44 pivots to meet the bearing plate 34 of the duckbill 28 when the wedge 32 is driven between the duckbill 28 and the bearing surface 38. This ensures that the surface of the second half 44 is always flat against the duckbill bearing plate 34 when the mast 18 is in the erect condition.

The pivot wedge 32 may be replaced with another abutment mechanism as desired. For example, the pivot wedge 32 may be replaced with a plate mounted on a universal joint at the lower end of an hydraulic cylinder, where the hydraulic cylinder replaces the pneumatic cylinder 40. Using the universal joint means that abutment of the duckbill 28 with the plate of the hydraulic cylinder will cause the plate to lie flat against the duckbill and the hydraulic cylinder will maintain the plate, and thereby the duckbill, in position.

In addition to the foregoing set up and use of the rig 10, a specific setup process may be used for setting up the mast 18 in an extended condition. That process may include:

1. reversing the rig 10 to around 3 m from the well head;
2. raising the mast 18 to a general vertical condition—±2;
3. extending the teleboom 24 and locking it in position using locking pins;
4. lowering the working platform to a horizontal position and lifting it to around 0.5 m above the top of the well head to enable visibility of the well head by an operator on the platform;
5. extending stabilisers (jack legs 20) to around 100 mm above the ground;
6. reversing the rig 10 over the well until the centerline of the well is around 1300 mm form the pivot of the mast 18—this can be achieved using markings provided on the working platform;
7. extending the jack legs 20 further and locking them into position;
8. extending outriggers and outrigger jack legs until they engage the ground;
9. tilting the mast 18 until the hook is in line with the well centerline—ideally, the angle of the mast 18 when in this condition will be around 3.2°;
10. inserting the pivot wedge 32 between the duckbill 32 and bearing plate 38; and
11. locking the duckbill 32 in position on the frame 16 thereby preventing movement of the upper end of the teleboom 24 (i.e. the mast crown) towards the cabin 14, and the pivot wedge 32 prevents movement of the mast crown away from the cabin 14;

if the mast 18 needs to be retracted, the sequence of steps is reversed back to step 9, and then;
12. retracting the mast 18;
13. tilting the mast 18 until the drawworks extend downwardly along the centerline of the well head—this angle will be approximately 5° to 6°;
14. inserting the pivot wedge 32 between the duckbill 32 and bearing plate 38; and
15. locking the duckbill 32 in position on the frame 16 thereby preventing movement of the upper end of the teleboom 24 (i.e. the mast crown) towards the cabin 14, and the pivot wedge 32 prevents movement of the mast crown away from the cabin 14.

Similarly, a specific setup process may be used for setting up the mast 18 in a retracted condition. That process may include:

1. reversing the rig 10 to around 3 m from the well head;
2. raising the mast 18 to a general vertical condition—±2;
3. lowering the working platform to a horizontal position and lifting it to around 0.5 m above the top of the well head to enable visibility of the well head by an operator on the platform;
4. extending stabilisers (jack legs 20) to around 100 mm above the ground;
5. reversing the rig 10 over the well until the centerline of the well is around 1300 mm form the pivot of the mast 18—this can be achieved using markings provided on the working platform;
6. extending the jack legs 20 further and locking them into position;
7. extending outriggers and outrigger jack legs until they engage the ground;
8. tilting the mast 18 until the hook is in line with the well centerline—ideally, the angle of the mast 18 when in this condition will be around 5° to 6°;
9. inserting the pivot wedge 32 between the duckbill 32 and bearing plate 38; and
10. locking the duckbill 32 in position on the frame 16 thereby preventing movement of the upper end of the teleboom 24 (i.e. the mast crown) towards the cabin 14, and the pivot wedge 32 prevents movement of the mast crown away from the cabin 14;

if the mast 18 needs to be extended, the sequence of steps is reversed back to step 8, and then;
11. extending the teleboom 24 and locking it in position using locking pins;
12. tilting the mast 18 until the drawworks extend downwardly along the centerline of the well head—this angle will be approximately 3.2°;
13. inserting the pivot wedge 32 between the duckbill 32 and bearing plate 38; and
14. locking the duckbill 32 in position on the frame 16 thereby preventing movement of the upper end of the teleboom 24 (i.e. the mast crown) towards the cabin 14, and the pivot wedge 32 prevents movement of the mast crown away from the cabin 14.

At the upper end of the teleboom 24 is a guide member, in the form of a sheave 46, about which the drawworks line 47 passes from the drawworks winch 49 to the well (not shown). To ensure forces applied by the drawworks act down through the mast 18, the centre of the sheave 46 is typically positioned to lie along the centerline X-X of the mast 18. In the embodiment shown in FIG. 3, the centre of the sheave 46, taken along line Y-Y, is positioned rearwardly of the centerline X-X of the teleboom 24. By positioning the sheave 46 rearwardly of the centre of the teleboom 24, the vertical drop of the drawworks line from the sheave 46 towards the well is further rearward than is the case for sheaves positioned centrally on the mast 18. As a consequence, the angle of the mast 18 can be reduced by a small margin. Given the size of the forces applied through the mast 18, reducing the angle of the mast 18 by a smaller margin can potentially significantly increase the load bearing capacity of the mast 18. The position of the sheave 46 is determined so that, with a maximum angle on the mast 18, the forces applied to the mast 18 nevertheless pass generally down through or around the pivot axis.

In the claims which follow and in the preceding description of the a flushby rig and some of its components, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the flushby rig and/or its components.

It will be understood to persons skilled in the art of the invention that many modifications may be made, and selected features from one embodiment described above may be incorporated into other embodiments, without departing from the spirit and scope of the present disclosure.

The invention claimed is:

1. A mast assembly for a rig, the assembly comprising:

a mast having a main boom; and a mast support of the rig;

wherein, in use, the mast can pivot between a stowed condition and an erect condition, and when in the erect condition the mast is erected past vertical;

wherein the main boom has a lower end adapted for pivotal connection to the mast support of the rig, and a mast stop extending from the lower end of the main boom, and when the mast is in the erect condition the mast stop abuts the mast support at a position spaced from the lower end; and wherein the mast support comprises a bearing surface at least partially formed by the mast stop; an abutment mechanism for limiting an angular position of the mast relative to the bearing surface when the mast is in the erect condition; and an adjustment device for adjusting a position of the abutment mechanism on the bearing surface to match the angular position of the mast when in the erect condition past vertical.

2. A mast assembly according to claim 1, wherein the mast stop comprises one or more fastening points at which, in use, the mast stop can be fastened to the mast support thereby to fix the mast in the erect condition.

3. A mast assembly according to claim 1, wherein the mast stop has a duckbill shape.

4. A mast assembly according to claim 1, wherein the adjustment mechanism slides the abutment mechanism along the bearing surface to adjust the position of the abutment mechanism on the bearing surface.

5. A mast assembly according to claim 4, wherein the position of the abutment mechanism on the bearing surface can be adjusted to match one of a wide range of angular positions of the mast when in the erect condition past vertical.

6. A mast assembly according to claim 1, wherein the abutment mechanism comprises a wedge that wedges between the bearing surface and the mast stop in use.

7. A mast assembly according to claim 6, wherein the bearing surface is at least partially formed by the mast stop and at least partially formed by an opposing bearing plate, and the bearing surface is v-shaped to wedge the wedge between the bearing surface and the mast stop in use.

8. A mast assembly according to claim 6, wherein the wedge is a pivot wedge.

9. A mast assembly according to claim 8, wherein the pivot wedge comprises two halves pivotally interconnected.

10. A mast assembly according to claim 9, wherein one of the halves is adapted to slide along the bearing surface.

11. A mast assembly according to claim 9, wherein one of the halves is adapted to be contacted by the bearing surface of the mast stop and to pivot as a result of contact with the bearing surface to present a flat surface for abutment with the bearing surface of the mast stop.

12. A mast assembly according to claim 1, wherein the abutment mechanism prevents movement of a crown of the mast away from a cabin of the rig in use.

13. A mast assembly according to claim 1, wherein a lower end of the mast is releasably fixed in position on the rig, in use, thereby to prevent movement of the crown of the mast towards a cabin of the rig.

14. A mast assembly according to claim 1, further comprising a guide member at the upper end of the mast for running a drawworks line of the rig, wherein a centerline of the guide member is offset from a centerline of the mast in a rearward direction when the mast is in an erect condition.

15. A mast assembly according to claim 14, wherein the guide member is a sheave.

16. A mast assembly according to claim 1 wherein the rig is one of a flushby rig, a workover rig and an intervention rig.

* * * * *